US005367729A

United States Patent [19]

Lazar et al.

[11] Patent Number: 5,367,729

[45] Date of Patent: Nov. 29, 1994

[54] HOSPITAL BEDDING SYSTEM

[76] Inventors: Norma Lazar; Albert G. Lazar, both of 1838 Camberley La., Hacienda Heights, Calif. 91745

[21] Appl. No.: 143,865

[22] Filed: Oct. 27, 1993

[51] Int. Cl.[5] ..... A47G 9/02

[52] U.S. Cl. ..... 5/494; 5/484; 5/496; 5/498; 5/460

[58] Field of Search ..... 5/484, 494, 496, 498, 5/460

[56] References Cited

U.S. PATENT DOCUMENTS

| | | | |
|---|---|---|---|
| 664,665 | 3/1900 | DaschBach . | |
| 710,477 | 10/1902 | Littell . | |
| 2,630,587 | 3/1953 | Brown | 5/496 |
| 2,763,875 | 9/1956 | Piontkowski | 5/333 |
| 2,982,976 | 5/1961 | Ferolito | 5/484 X |
| 3,066,321 | 12/1962 | Kintner | 5/320 |
| 3,066,323 | 12/1962 | Kintner | 5/334 |
| 3,179,958 | 4/1965 | Carris | 5/334 |
| 3,243,827 | 4/1966 | Kintner | 5/334 |
| 3,413,665 | 12/1968 | Amet | 5/334 |
| 3,530,487 | 9/1970 | Beer | 5/334 |
| 3,654,059 | 4/1972 | Zisblatt | 161/109 |
| 3,832,743 | 9/1974 | Smith | 5/334 |
| 3,855,655 | 12/1974 | Propst | 5/317 |
| 3,879,777 | 4/1975 | Walker | 5/334 |
| 3,965,504 | 6/1976 | Ainsworth | 5/334 |
| 4,040,133 | 8/1977 | Gilreath | 5/320 |
| 4,045,832 | 9/1977 | DiForti et al. | 5/334 |
| 4,144,602 | 3/1979 | Fernandes | 5/334 |
| 4,241,466 | 12/1980 | Mendyk | 5/497 |
| 4,301,561 | 11/1981 | McLeod | 5/496 |
| 4,413,368 | 11/1983 | Schuetze | 5/494 |
| 4,470,857 | 9/1984 | Casalou | 156/66 |
| 4,488,323 | 12/1984 | Colburn | 5/460 |
| 4,549,323 | 10/1985 | Brockhaus | 5/455 |
| 4,587,683 | 5/1986 | Gardiner | 5/493 |
| 4,807,316 | 2/1989 | Whipple | 5/493 |
| 4,833,744 | 5/1989 | Correa | 5/496 |
| 4,916,766 | 4/1990 | Grandy | 5/496 |
| 4,979,251 | 12/1990 | Lazar | 5/496 |
| 4,991,242 | 2/1991 | Brown | 5/60 |
| 5,042,099 | 8/1991 | Brenner et al. | 5/496 X |

*Primary Examiner*—Michael F. Trettel
*Attorney, Agent, or Firm*—Rogers & Wells

[57] ABSTRACT

A bedding system for hospital beds comprises a mattress with releasibly connectable hook fasteners on the mattress end surfaces, a bottom sheet with releasibly connectable loop fasteners on each end, and an optional top sheet with releasibly connectable loop fasteners at the foot end and an optional draw sheet with releasibly connectable loop fasteners on each end. If the mattress is used with the draw sheet, it has releasibly connectable hook fasteners along the edge of each major surface. If the bottom sheet is to be used with the top sheet, the bottom sheet is connected so that the entire mattress head end is covered while only the top half of the mattress bottom end is covered, leaving the lower half of the hook material (on the mattress foot end) exposed and available to accept attachment of the top sheet.

When utilizing conventional hospital sheets, patient movement and/or cranking up the bed contributes to wrinkled sheets and bedsores. The present bottom sheet, which is securely anchored to the head and foot of the mattress automatically returns to its original taut position each time the bed is lowered to a flat position. This aids in reducing wrinkles and potential bedsores and enhances the patient's comfort.

20 Claims, 4 Drawing Sheets

HOSPITAL BEDDING SYSTEM

FIELD OF THE INVENTION

The present invention relates generally to bedding and more particularly to a means for securing hospital sheets and a draw sheet to a hospital mattress.

BACKGROUND OF THE INVENTION

In maintaining a hospital bed in a clean, smooth and comfortable condition, it is necessary to make the bed daily and occasionally to change and replace the sheets and draw sheets even more frequently. Typically, the sheets are first placed on the bed and then tucked under the mattress which requires lifting the edges and ends of the mattress. Making beds in this manner is time consuming and can cause considerable back strain. It is especially difficult for the person making the bed, as well as uncomfortable for the patient when an occupied bed must be changed.

It is known to use various fastening materials, e.g., multiple buttons, zippers, hooks or snaps on bedding and on mattresses to secure and facilitate positioning of the bedding on the mattress. These systems propagate, however, the inconvenience of lifting the mattress to put the sheet on and bedding with these fasteners has never proven commercially viable. The use of hook and loop fastening material on bedding and on mattresses to facilitate the positioning of the bedding is known. See for example U.S. Pat. Nos. 4,916,766 (to Grandy), 4,144,602 (to Fernandes), 4,045,832 (to Di Forti et al.), 4,040,133 (to Gilreath for releasable attachment), 3,965,504 (to Ainsworth), 3,179,958 (to Carris for buttoned down sheets), 3,066,321 (to Kintner), 3,066,323 (to Kintner), 3,832,743 (to Smith), 3,243,827 to Kintner), all of which have several disadvantages. See U.S. Pat. No. 4,979,251 (to Lazar) which circumvents the various disadvantages found in the other bedding systems. The Lazar '251 patent is not, however, directed to a hospital bedding system. The mattress has attachment points on the side surfaces and end surfaces, with the bottom sheet being attached to the side surfaces and the top sheet being attached to the foot end surface.

U.S. Pat. No. 4,488,323 (to Colburn) discusses the disadvantages of using conventional unfitted or flat bedsheets on beds, i.e., difficulty in making the bed, especially with bedridden patients, and wrinkling which can cause irritation and promote the formation of bedsores. It also discusses the advantages of fitted sheets but points out their disadvantages, i.e., tearing at the corners and difficulty in making the bed, particularly hospital beds when it is not possible to move a patient to change the sheet. The '323 patent discloses, in the preferred embodiment, a bedding system which has strips of hook or loop fastening material encircling the sides and ends of the mattress or alternatively only the sides. The strips are placed one above the other and matching strips of loop or hook material attached to underside of the sheets near the edges. The bottom sheet is smaller than the top sheet and the strip of fastening material on the bottom sheet is attached to the upper strip of fastening material on the side of the mattress. The strip of fastening material on the top sheet is attached to the lower strip of the fastening material on the side of the mattress. This system is both costly and impractical. It is costly because the hook or loop material encircles the major portion of the mattress. It is impractical. Making beds by mating large areas of hook and loop material is both difficult and time consuming since whenever the materials inadvertently touch, that area must be disengaged and repositioned.

The draw sheets presently utilized by most hospitals are unsatisfactory. Often the practice is to fold and refold a conventional sheet to the desired size and shape and then place the folded sheet in the center of the bed in order to enhance patient comfort while also serving as a protective pad and as a means for transferring a patient from a bed onto a gurney. The process of placing a conventional draw sheet on a hospital bed requires tucking in a substantial amount of fabric beneath the mattress at each side of the bed. This is especially difficult when the bed is occupied due to the weight of the patient. In theory, the idea is good and quite satisfactory while the patient remains quiet and in a prone position. In practice, it is a failure. If the patient is unusually active or as soon as the bed is elevated to a sitting position, the draw sheet tends to slip and bunch-up, becoming an irritant rather than a comfort, possibly causing or aggravating bed sores problems.

Thus, there exists a substantial need for an improved hospital bed sheet mounting system which overcomes the problems and drawbacks discussed above. A system is needed which allows a bed to be made quickly, which eliminates lifting the mattress along the edges to tuck sheets under the mattress, and which still allows the mattress to be turned end for end and side to side without affecting the operability of the bed sheet mounting system. There also exists a need for a bed sheet mounting system which can be used by the physically handicapped and the blind and which eliminates the need to lift the mattress or move the bed away from a wall. There also exists a need for an improved draw sheet.

SUMMARY OF THE INVENTION

The present invention provides a new and convenient hospital bedding system which allows a bottom sheet and optionally a top sheet and/or a draw sheet to be secured to a mattress, typically a waterproof mattress, without introducing the drawbacks associated with the prior art bedding systems discussed above.

In this hospital bedding system, the bottom sheet and optionally the top sheet are releasibly connectable to the mattress via the agency of cooperating areas of hook material (referred to as hook fasteners) on the mattress and loop material (referred to as loop fasteners) on the sheets. In a preferred embodiment, a draw sheet is releasibly connectable to the mattress via the agency of cooperating areas of hook material (referred to as hook fasteners) on the underside of the mattress and loop material (referred to as loop fasteners) on the ends of the draw sheet.

As used herein, the term "hospital bedding" is not limited to only the bedding used in hospitals but includes the bedding used on beds in convalescent homes or in private homes where ill or handicapped people may need to use hospital style adjustable beds, as well as the bedding used in institutions such as prisons or military establishments.

The mattress has opposite top and bottom major surfaces with opposite side edges and end edges. The mattress is bounded by side surfaces and head and foot end surfaces normal to the major surfaces. The mattress has a plurality of hook fasteners, at least two and preferably three, secured to each end surface. When three fasteners are used, it is easier to center the sheets on the mattress because one can use the middle fastener as a guide for aligning it with a middle fastener on the end surface of the sheet. Rectangular hook pieces are preferred. The longer sides extend vertically substantially between the mattress major surfaces and the shorter side are disposed proximate the edges of the mattress ends. The hook pieces are disposed in essentially identical predetermined patterns symmetrical about each end surface, whereby the patterns are essentially the same relative to the mattress' major surfaces regardless of which major surface is the top surface and which is the bottom surface. The predetermined pattern is substantially the same as the predetermined pattern of loop material on the head and foot ends of the bottom sheet and on the foot end of the top sheet.

In the draw sheet embodiment, the mattress has additional pieces of hook material, preferably two or three rectangular pieces, which are secured to the mattress major surfaces in a predetermined pattern which is disposed in an essentially identical pattern on each major surface symmetrical about the center of the major surfaces, whereby the patterns are essentially the same regardless of which major surface is the bottom surface. The predetermined pattern is substantially the same as the predetermined pattern of loop material on the ends of the draw sheet. The predetermined patterns are arranged so that the draw sheet loop material engages a portion of the mattress hook material. When three fasteners are used, it is easier to center the draw sheet over the bottom sheet because one can use a middle fastener, placed in the middle of the draw sheet, as a guide for aligning it with a middle fastener along the side of the bottom major surface of the mattress.

In the preferred embodiment, one of the long sides of the rectangular hook material is disposed along the side edges of the mattress surface and the rectangular loop material on the draw sheet is disposed so that one of the short sides is along the end edge of the draw sheet. With this arrangement there is greater flexibility when the hook and loop fasteners are engaged. In alternate embodiments, the mattress hook material is disposed on the mattress so that one of the short sides of the rectangle is along the side edges of the mattress surface and the draw sheet loop material is disposed on the draw sheet so that one of the long edges is along the end edges of the draw sheet.

As used herein, referring to the patterns "as essentially the same" does not mean the patterns are identical but rather related in such a way that the cooperating hook and loop fasteners connect and secure the bed sheets or draw sheet to the mattress.

As used herein, the term "secured to the mattress" refers to mattresses or mattress covers manufactured with hook pieces thereon or to existing mattresses or mattress covers, adapted after original manufacture, to include the hook pieces.

The design of the bottom sheet permits it to be used either with a conventional top sheet or with a top sheet having loop material disposed thereon for reversibly connecting the top sheet to the mattress. The bottom sheet is a simple rectangular sheet of fabric such as a polyester-cotton blend or a knitted fabric which is more flexible and can accommodate more variations in the mattress size. The sheet has obverse and reverse surfaces, opposite side edges, and opposite head and foot end edges. The sheet includes a plurality of pieces of loop material secured to the bottom sheet reverse surface proximate the end edges and disposed horizontally in each instance in a predetermined pattern which can be reversibly connected with a portion of the hook material disposed on the end surfaces of the mattress in a predetermined pattern. The ends of the bottom sheet have the same number of loop fasteners as the mattress has hook fasteners on its head and foot ends. The distance between the side edges of the sheet is a selected amount greater than the distance across the mattress major surface. Typically, it is the distance across the mattress plus an amount equal to about twice the thickness of the mattress. The distance between the end edges of the bottom sheet is critical. It is the distance between the ends of the mattress plus one and one-half times the thickness of the mattress.

The bottom sheet is aligned with the mattress by its placement on the mattress such that it hangs evenly over the side edges of the mattress and so that it completely covers the head end of the mattress, but only the top half of the bottom end of the mattress. The loop material on the bottom sheet is then pressed against the hook material on the mattress, thus securing the sheet to the mattress. This leaves the bottom half of the mattress foot end uncovered so that the exposed hook fasteners can be used to attach the optional top sheet having loop fasteners.

One skilled in the art will recognize that if the bottom sheet is to be used with a conventional top sheet, it is not necessary to leave the bottom half of the mattress foot end uncovered. In this embodiment, the bottom sheet can be centered on the mattress so that about three-quarters of each mattress end is covered, or the entire foot end may be covered with only 50% of the head and covered, depending upon which ratio a user prefers.

In the preferred embodiment, larger rectangular hook fasteners (4 by 2 inches) extend vertically between the mattress major surfaces and smaller rectangular loop fasteners (3 by 1.5 inches) extend horizontally along the end edges of the sheet. This sizing of the fasteners provides more leeway in aligning the fasteners. The horizontal-vertical arrangement of the hook-loop fasteners also provides greater flexibility than a horizontal-horizontal or vertical-vertical arrangement of hook-loop fasteners. In addition, it is easier to sew the horizontally extended rectangular loop fasteners into the hems on the sheet ends.

The top sheet is a simple rectangular sheet of fabric such as a polyester-cotton blend or a knitted fabric. The sheet has obverse and reverse surfaces, opposite side edges, and opposite head and foot end edges. The top sheet can be an ordinary hospital sheet. The preferred top sheet includes a plurality of pieces of loop material, at least two and preferably three, secured to the top sheet's reverse surface proximate to the foot edge only. The number of loop fasteners will be the same as the number of hook fasteners on the mattress ends. The loop fasteners are disposed in a predetermined pattern which is essentially identical to the predetermined pattern on the mattress ends. The preferred loop fasteners are rectangular pieces (e.g., 1.5 by 3 inches) which are aligned so that a long side is along the foot end edge.

This preferred top sheet with the loop fasteners is releasibly connectable with the lower portion of the hook material on the foot end of the mattress. The top sheet is placed on the mattress with the reverse surface being over the bottom sheet such that it hangs evenly over the sides of the mattress. The loop fasteners on the reverse surface at the foot end of the sheet are aligned with the exposed lower half of the hook fasteners on the foot end of the mattress. The exposed area of hook fasteners is the lower part of the hook material which is left uncovered when the bottom sheet is aligned and connected to the mattress as described above. The loop fasteners on the reverse side of the top sheet are then pressed against the exposed hook fasteners on the bottom end of the mattress, thus securing the top sheet to the mattress.

The hospital bedding system can also include a draw sheet, optionally with a waterproof liner and preferably with a pocket. The draw sheet is a simple rectangular sheet of fabric, preferably quilted for comfort and absorbency. The draw sheet has obverse and reverse surfaces and opposite side edges and opposite end edges. Pieces of loop material, hereafter referred to as loop fasteners, are secured to the reverse surface on each end of the draw sheet near the side edges. The loop fasteners are disposed in an essentially identical predetermined pattern related to the predetermined pattern of hook fasteners on the mattress major surfaces. The number of loop fasteners on each end will be the same as the number of hook fasteners along each side edge of the mattress major surfaces. In some cases, three fasteners are preferred because, as discussed above, this makes alignment easier. The length of the draw sheet is equal to the width of the mattress plus twice the depth of the mattress plus an additional length of fabric (typically about 3 inches) on each end for securing the loop fasteners on the draw sheet to the hook fasteners on the mattress.

The draw sheet is placed over the bottom sheet and centered on the bed so that the ends extend over the side surfaces of the mattress and are in a position to easily engage the hook fasteners on the bottom mattress major surface. The draw sheet's ends are placed under the mattress and the loop fasteners are pressed against the hook fasteners on the mattress bottom major surface, thus securely anchoring the draw sheet to the mattress over the bottom sheet. This anchoring system permits bending with far less bunching. When the bed is returned to the prone position, the draw sheet automatically returns to its original flat configuration.

One skilled in the art will recognize that other equivalent releasibly connectable fasteners will be useful in the present hospital bedding system. The hook and loop materials used herein are commonly sold under the trademark VELCRO or SCOTCHMATE.

Only loop material is used on the bottom and top sheets and draw sheet since the abrasive action of hook material on the sheets would soon destroy the sheets in the laundering process.

An example of a bedding system for a hospital mattress which measures 38 inches wide by 75 inches long by 4 inches deep is provided. The system includes a bottom sheet which measures 46 inches finished width by 81 inches finished length, a top sheet which measures 66 inches finished width by 86 inches finished length, and a quilted draw sheet which measures 36 inches by 50 inches, with the quilted portion being 36 inches by 36 inches. The mattress has three pieces of rectangular hook material attached vertically at the head end and three pieces of rectangular hook material attached vertically at the foot end in the same predetermined pattern. Each piece of hook material is about 2 by 4 inches. For attaching the drawsheet, the mattress also has eight pieces of rectangular hook material, each being about 2 by 3 inches, attached horizontally along the side edges of each of the mattress major surfaces, with four fasteners on the bottom major surface and four fasteners on the top major surface for attaching the draw sheet whenever the mattress is reversed. The reverse surface of the bottom sheet has six corresponding pieces of loop material, three loop fasteners on each end, each being 1.5 by 3 inches, attached horizontally at the head and foot end of the sheet. The reverse surface of the top sheet has three pieces of rectangular loop material, 1.5 by 3 inches, with these loop fasteners attached horizontally only at the foot end of the top sheet. The reverse surface of the draw sheet has four pieces of rectangular loop material, with two loop fasteners at each end, each 1.5 by 3 inches, attached vertically (i.e., with a shorter side of the rectangle along the end edges).

The above-described hospital bedding system provides an improved way to mount the bottom sheet and the top sheet to a mattress. Both the bottom sheet and top sheets are rectangular and flat (i.e., they do not have fitted, mitered or shaped corners) and are easy to use. The advantage provided to the patient includes the fact the bottom sheet, being anchored in place at both ends, wrinkles far less and stays neater when the hospital bed is rolled up. The patient will be more comfortable because each time the hospital bed is returned to the prone position, the bottom sheet is automatically straightened and stretched back to a flat configuration.

The above described bedding system has several other advantages. First, one can make a bed in about half the time needed with normal flat or fitted sheets. In addition, because it is not necessary to lift the mattress to attach the sheets, the person making the bed can avoid back strain, which benefit is of great interest to hospitals and other institutions who employ persons whose principal duties include changing and making a number of beds each day. This easier bed-making benefit is also of great interest to people with arthritis, physical disabilities, and to those blind persons who would prefer to make their own beds by utilizing hook and loop placements as tactile guideposts in attaching sheets to a mattress. Second, manufacturing costs are reduced because the sheets can be narrower and shorter than conventional sheets because the sheets do not need to be tucked under the sides or ends of the mattress. About 41% less fabric is needed for a two piece set of sheets. This reduction in size leads to a reduction in laundry costs since the sheets weigh less and less water, less detergent, and less energy are used in laundering them, thus reducing pollutants returned to the eco system

BRIEF DESCRIPTION OF THE DRAWINGS

The above-mentioned and other features of this invention are more fully set forth in the following description of one presently preferred embodiment of the invention, which description is presented with reference to the drawings, wherein.

DETAILED DESCRIPTION OF THE PREFERRED EMBODIMENTS

Figure 1:
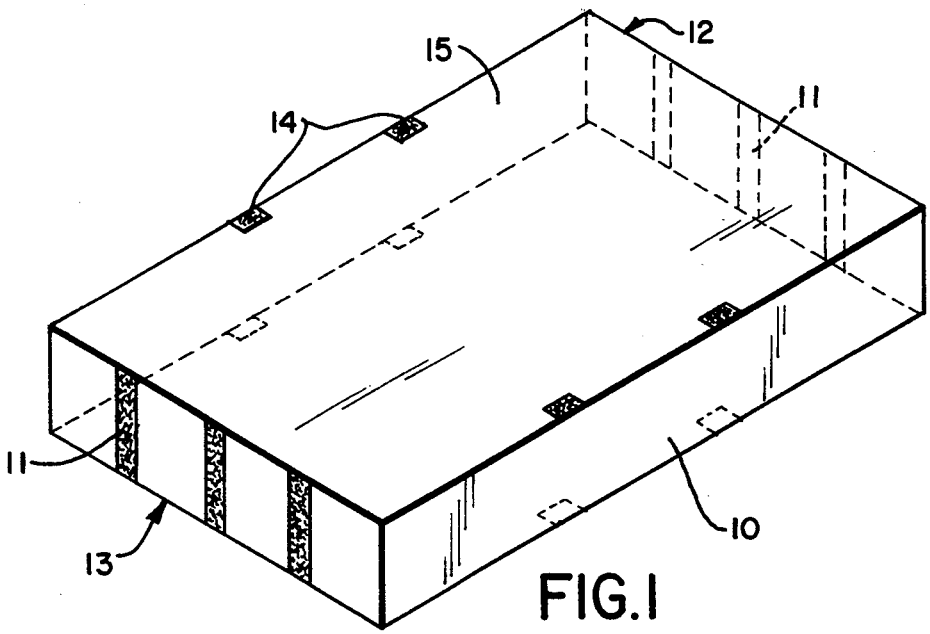
FIG. 1 is a perspective view of a hospital mattress showing the hook fasteners at the head and foot ends of the mattress for releasibly connecting the bottom sheet and optional top sheet and the hook fasteners on the mattress major surfaces for releasibly connecting the draw sheet to the mattress.

The mattress 10, as shown in FIG. 1, can be a standard commercially available mattress, e.g., a hospital mattress which is typically waterproof and often used without a mattress pad. The required pieces of hook material 11 are attached, as by bonding or sewing along the head end 12 and foot end 13 of the mattress 10. The required pieces of hook material 11 may be of any suitable shape, preferably rectangular, and placed in any predetermined pattern on the ends 12 and 13 which pattern is vertically symmetrical about the centerline of the ends of the mattress and symmetrical between the ends of the sides of the mattress. The preferred rectangular pieces (4 inches long by 2 inches wide) extend between the mattress major surfaces 15 as shown in FIG. 1.

The first pattern of hook material on the mattress 10 is matched on both ends so that, from time to time as is recommended by mattress manufacturers, the mattress 10 can be turned side-for-side or turned end to end, or even turned top to bottom without interfering with how the bottom sheet 15 cooperates with the mattress 10.

Optionally, additional pieces of hook material 14 are attached, as by bonding or sewing, on the mattress major surfaces 15 near the side edges. The optional pieces of hook material 14 may be of any suitable shape, preferably rectangular, and placed in any predetermined pattern which is symmetrical about the centerline of the major surfaces 15 of the mattress 10. The preferred rectangular pieces (3 inches long by 2 inches wide) are placed horizontally along the side edges as shown in FIG. 1.

The second pattern of optional hook material on the mattress 10 is matched on both major surfaces 15 so that, from time to time as is recommended by mattress manufacturers, the mattress 10 can be turned side-for-side or turned end to end, or even turned top to bottom without interfering with how the bottom sheet 16 cooperates with the mattress 10.

The required and optional pieces of hook material (11 and 14) may be of the same size and shape, though they need not be so as they normally will sustain different levels of load in use. Any shape fasteners can be used as long as there is sufficient contact between the hook fasteners and loop fasteners. Circular coins (Velcoins) can be used. Preferably, however, the required pieces of hook material 11 are uniformly wide strips of hook material (e.g., 2 inches wide) cut into pieces of sufficient length (e.g., 4 inches long) to encompass substantially the full depth of the mattress end surfaces to which they are attached with their long dimensions extending between the mattress major surfaces 15. Preferably, the optional pieces of hook material 14 are also uniformly wide strips of hook material (2 by 3 inches) and they are preferably attached to the mattress major surfaces 15 along with their long dimensions extending along the side edges of the mattress 10.

The hook material 11 and 14 pieces can be attached to mattress 10 as a step in the manufacture of the mattress. Alternatively, the hook material pieces can be attached to an existing mattress or mattress cover, e.g., a protective plastic envelope. In the latter instance, the pieces of hook material can be provided, perhaps with cooperating pieces of pile or loop material, as elements of a kit (i.e., a retrofit kit) for adapting an existing mattress or mattress cover, and other bedding components, for use in accord with the teachings and principles of this invention.

Figure 2:
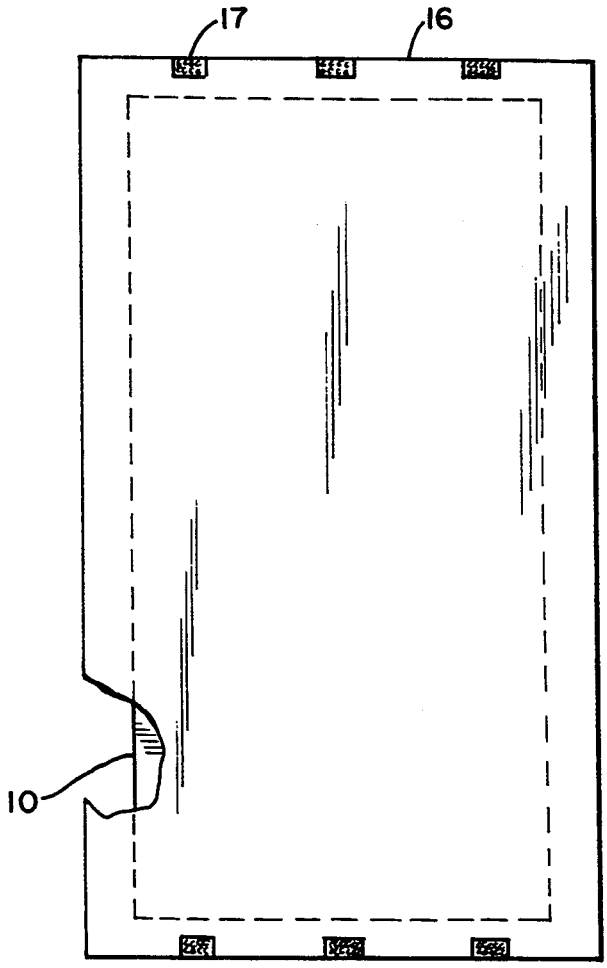
FIG. 2 is a bottom plan view of a bottom sheet showing the loop fasteners on each end of the reverse surface for releasibly connecting the bottom sheet to the hook fasteners on the head and foot ends of the mattress.

Referring now to FIG. 2, a bottom sheet 16 to which pieces of loop material 17, defined for cooperation with hook material, are attached at spaced locations along each of the sheet's short edges on the reverse side of the sheet 16. The attachment of the several pieces of loop material 17 to bottom sheet 16 is by sewing. Bonding or gluing is not typically used on the sheets or draw sheets since they are laundered. Loop material pieces 17 may be the same size and shape as hook material pieces 11. Preferably, they are smaller rectangular pieces (3 inches long by 1.5 inches wide) which makes connecting easier. The distance between long edges of the bottom sheet 16 is a selected amount greater than the distance across a major surface of the mattress 10 such that the long edges fall over the long sides of the mattress 10. The distance between the head edge and the foot edge of the bottom sheet 16 is critical. It is a selected amount greater than the distance across the major surface of the mattress between its end surfaces plus one and one half times the depth of the mattress, i.e., the distance between the mattress major surfaces 15.

Figure 3:
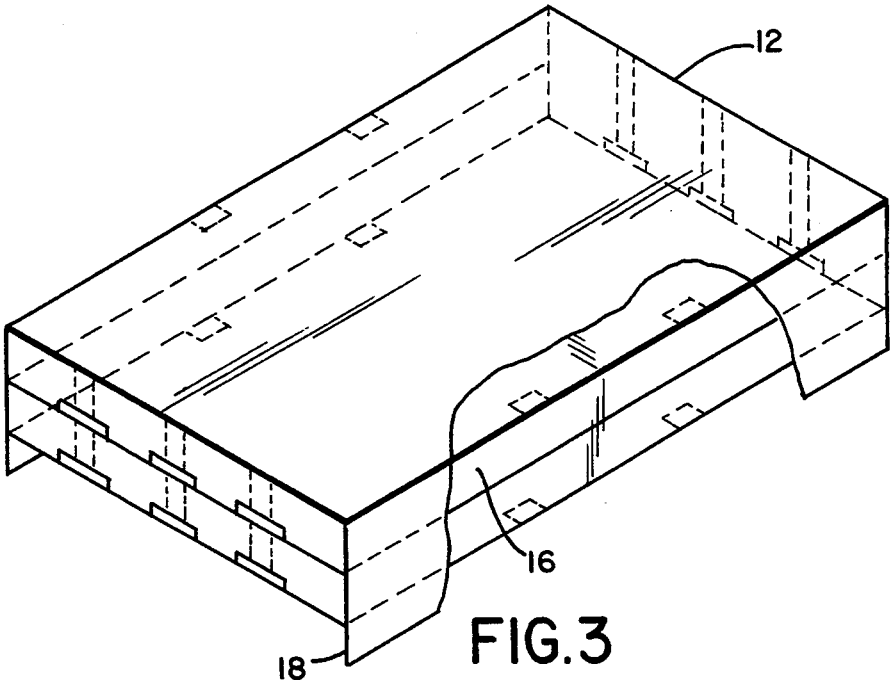
FIG. 3 is a top plan view of a mattress with bottom sheet and a top sheet connected to the hook fasteners at each end of the mattress.

FIG. 3 shows the relative location on the mattress 10 when the bottom sheet 16 is attached to the mattress 10 in a position to be used with the preferred top sheet 18. The bottom sheet 16 is centered lengthwise and widthwise on the mattress 10 so that the entire head end 12 of the mattress 10 is covered by the bottom sheet 16 and about one-half of the foot end 13 of the mattress 10 is covered by the bottom sheet 16. The top sheet 18 is centered widthwise on the mattress and centered lengthwise on the mattress so that the entire foot end of the mattress is covered with the foot end of the top sheet 18. The loop fasteners on the reverse side of the foot end of the top sheet 18 are connected with the hook material pieces 11 on the foot end 13 of the mattress 10.

Figure 4:
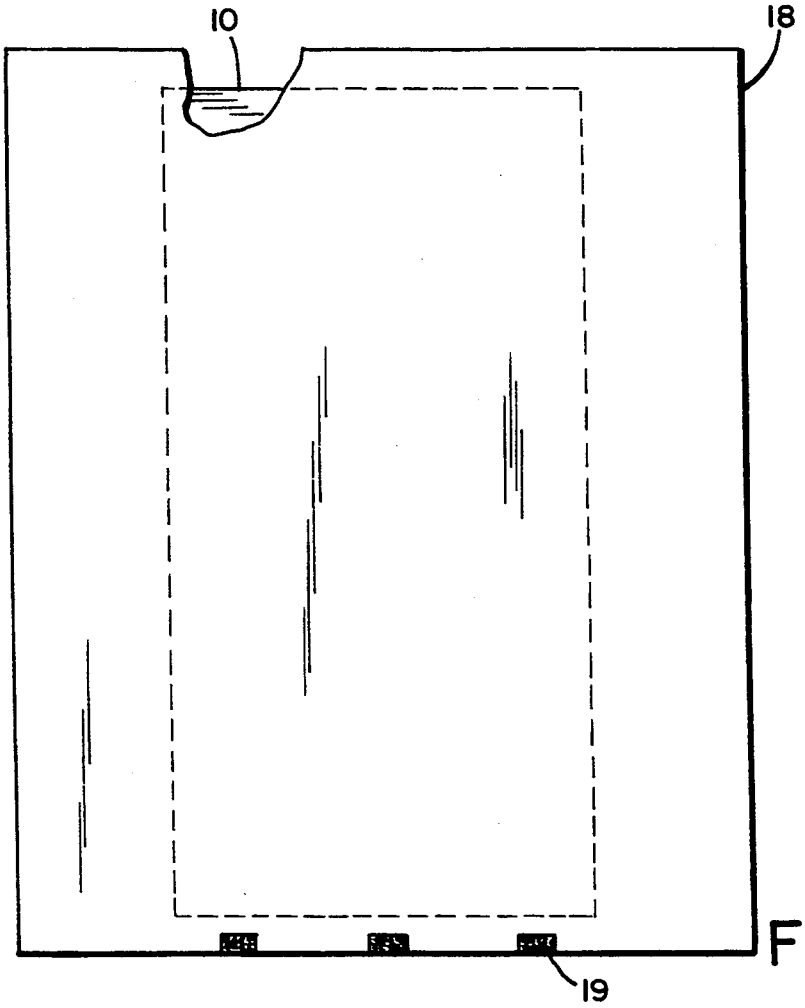
FIG. 4 is a top plan view of a top sheet showing the loop fasteners for releasibly connecting the top sheet to the hook fasteners on the foot end of the mattress.

FIG. 4 shows a preferred top sheet 18 to which loop material pieces 19, defined for cooperation with hook material, are attached at spaced locations along one of the sheet's short edges on the reverse side of the sheet 18. The attachment is typically by sewing. The sheet end to which the loop material is attached is the foot end of the sheet. Loop material pieces 19 may be the same size and shape as hook material pieces 11. Preferably, they are smaller rectangular pieces (3 inches long by 1.5 inches wide) which makes connecting easier.

Figure 5:
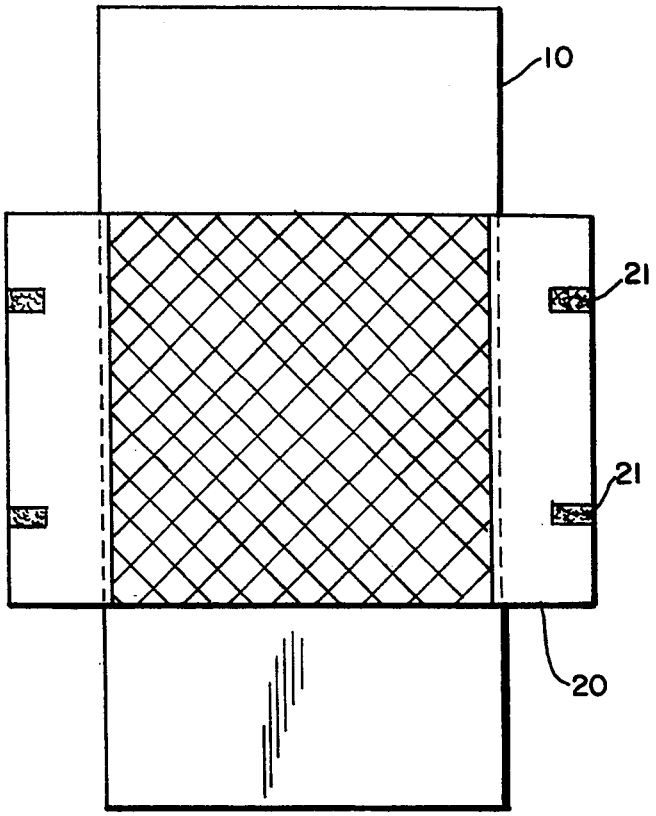
FIG. 5 is a bottom plan view of a draw sheet showing the loop fasteners on each end of the reverse surface for releasibly connecting the draw sheet to the hook fasteners on the bottom major surface of the mattress.

FIG. 5 shows an additional aspect of the invention which includes a draw sheet 20 as shown. The draw sheet 20 is a rectangular sheet of fabric having obverse and reverse surfaces and of a size sufficient to cover a portion of the top surface of the mattress 10. Pieces of loop material 21 are secured to the reverse surface of the draw sheet 20 proximate to each of its corners. The mattress 10 has pieces of hook material 14 secured on the bottom major surface 15 and preferably the top major surface 15. Preferably, rectangular pieces hook materials 14 are positioned horizontally near the edges at equal distances from the ends of the mattress as shown in FIG. 1.

Figure 6:
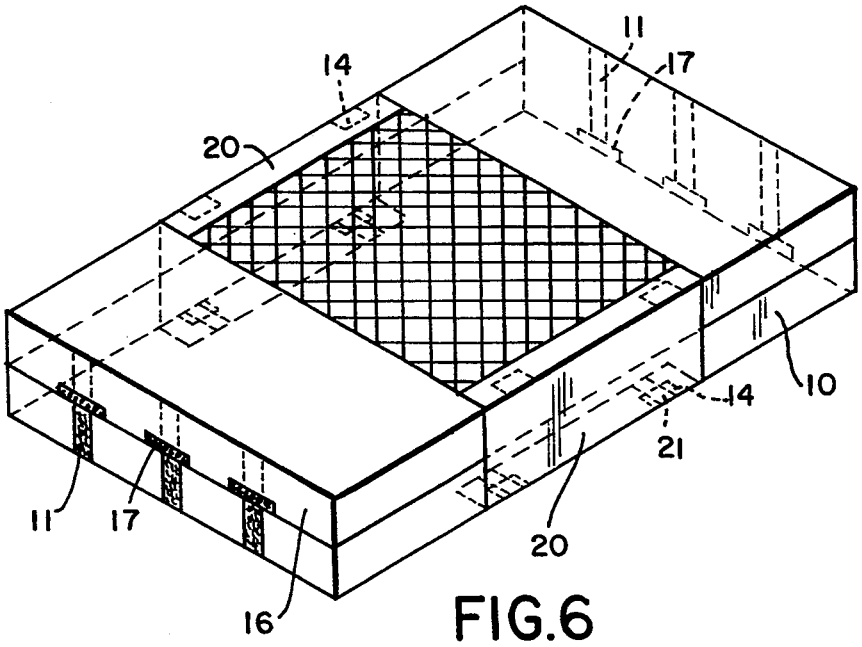
FIG. 6 is a perspective view of a mattress covered with a bottom sheet connected to the ends of the mattress and then covered with a draw sheet connected to the bottom major surface of the mattress.

Referring to FIG. 6, the draw sheet 20 is connected to the mattress 10 by its being placed over the bottom sheet 16 such that it is centered on the mattress 10 with the loop material 21 on the corners of the draw sheet 20 facing and aligned with the hook material 14 on the bottom major surface 15 of mattress 10. The loop material 21 on the draw sheet 20 is then connected with the hook material 14 on the bottom major surface 15 of the mattress 10 securing the draw sheet 20 over the bottom sheet 16 and to the mattress 10. Hook material 14 preferably is placed on both the top and bottom major surfaces 15 of the mattress 10 so the mattress 10 can be turned over periodically without interfering with the cooperation of draw sheet 20 with the mattress 10 in the manner described above.

Figure 7:
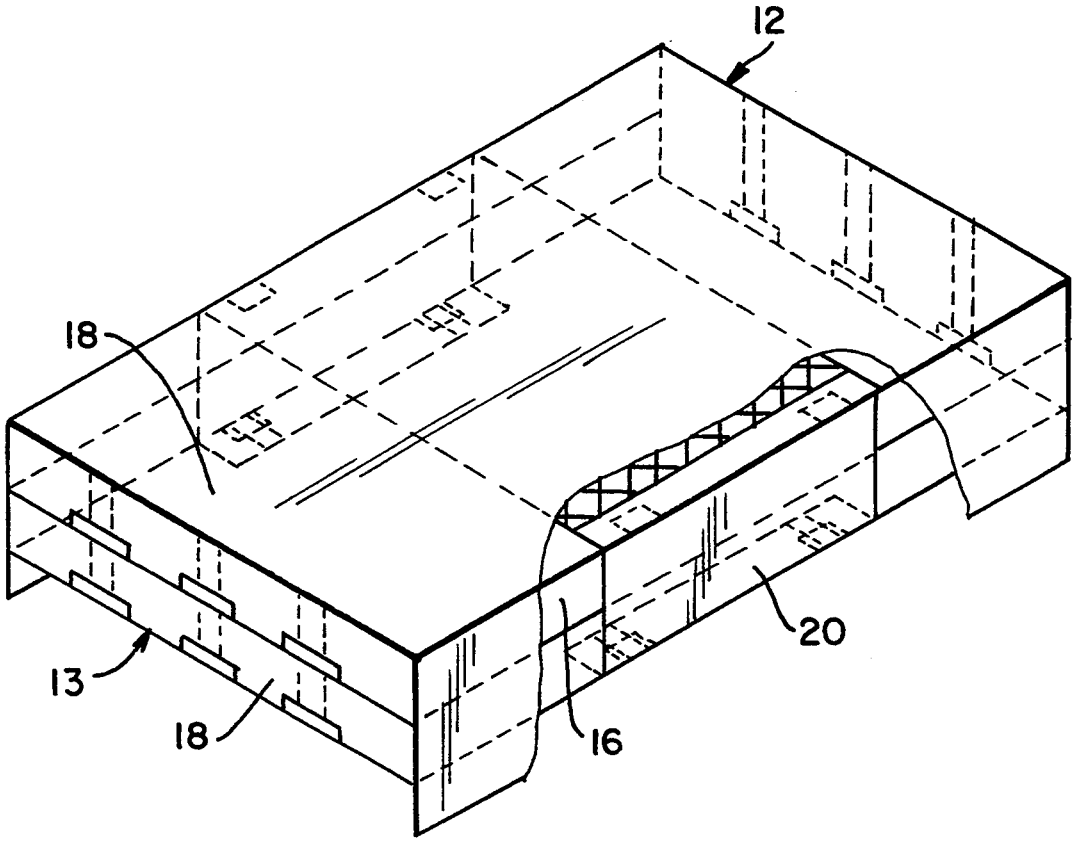
FIG. 7 is a top plan view of a bottom sheet, connected to the ends of the mattress so that the head end is completely covered and the top half of the foot end is covered, a draw sheet over the bottom sheet connected to the bottom major surface of the mattress, and a top sheet over the draw sheet and bottom sheet connected to the bottom half of the foot end of the mattress so that the foot end is completely covered.

FIG. 7 is a perspective view of complete attachments of bottom sheet 16 to the head end 12 and foot end 13 of mattress 10, of draw sheet 20 to the bottom major surface 15 of mattress 10, and of top sheet 18 to the foot end 13 of mattress 10. This figure shows that the bottom sheet 16 completely covers and is attached to the head end 12 of the mattress and covers and is attached to the top half of foot end 13 of mattress 10. It also shows that the foot end of top sheet 18 covers the entire foot end 13 of the mattress 10 and is attached to the bottom half of the foot end 13.

To make a bed using the bottom and preferred top sheet bedding system of the invention, the bottom sheet 16 is placed on the mattress 10, reverse side down, with the head-end of the bottom sheet 16 aligned with the head end 12 of the mattress 10. This means that a portion of the foot-head end of the bottom sheet 16 falls over the foot end 13 of the mattress 10 by one-half the distance from the upper edge of the foot end 13 of the mattress 10 to the lower edge of the foot end 13 of the mattress 10. The pieces of loop material 17 on the reverse of the properly placed bottom sheet 16 are then patted into engagement with the hook material 11 on the head end 12 and foot end 13 of the mattress 10. At this point, the lower half of the pieces of hook material 11 at the foot-end 13 of the mattress 10 remain exposed. The top sheet 18 is then placed, with its reverse surface down, on the bottom sheet 16 with the foot-end of the top sheet 18 overhanging the foot end 13 of the mattress 10 and aligned with the lower edge of the foot end 13 of the mattress 10. The pieces of loop material 19 attached to foot-end of the top sheet 18 are then patted into engagement with the exposed pieces of hook material 11 on the foot end 13 of the mattress 10. The head end of the top sheet, which has no loop material attached thereto, can then be folded back a desired distance as is common.

To make a bed using the bottom sheet, preferred top sheet, and draw sheet, one proceeds as above but, before placing on the top sheet 18, one places the draw sheet 20 with its reverse surface down over a central portion of the bottom sheet 16, with the draw sheet ends overhanging the sides of the mattress 10. One then aligns the loop pieces 21 on the ends of draw sheet 20 with the hook pieces 14 on the bottom major surface 15 of the mattress 10, lifts the side edges of mattress 10, and attaches the loop material pieces 21 on the ends of draw sheet 19 to the exposed hook material pieces 14 on the bottom major surface 15 of mattress 10.

Changes and modifications may be made without departing from the scope and spirit of the invention as set forth in the following claims.

What is claimed is:

1. A bedding system comprising (a) a mattress, (b) a bottom sheet releasibly connectable to the mattress via the agency of cooperating hook fasteners on the mattress and loop fasteners on the bottom sheet:

the mattress having opposite top and bottom major surfaces with opposite side edges and end edges and being bounded by head and foot end mattress surfaces and side mattress surfaces normal to the major surfaces, the mattress having a plurality of hook fasteners completely secured only to the mattress head and foot end surfaces for connecting the bottom sheet, the fasteners being disposed in essentially identical predetermined patterns symmetrical about the midlength of each end surface and extending substantially between the mattress major surfaces, whereby the patterns on the end surfaces are essentially the same relative to an actual mattress top surface and a mattress foot end surface regardless of which major surface is the top surface and which end surface is the foot end surface;

the bottom sheet having obverse and reverse surfaces and opposite side edges and head and foot end edges, the distance between the side edges being a selected amount greater than the distance across the mattress major surface between its side surfaces, the distance between the end edges being the distance across the mattress major surface between its end surfaces plus one and one half times the distance between the mattress major surfaces and having a plurality of loop fasteners secured to each end of the bottom sheet on the reverse surface proximate the end edges and disposed in a predetermined pattern related to the predetermined pattern of hook fasteners on the mattress end surfaces so that the loop fasteners overlap at least a portion of the hook fasteners on the mattress end surfaces.

2. A bedding system comprising (a) a mattress and (b) a bottom sheet releasibly connectable to the mattress via the agency of cooperating hook fasteners on the mattress and loop fasteners on the bottom sheet:

the mattress having opposite top and bottom major surfaces with opposite side edges and end edges and being bounded by head and foot end mattress surfaces and side mattress surfaces normal to the major surfaces, the mattress having a plurality of hook fasteners secured to the mattress head and foot end surfaces for connecting the bottom sheet, the fasteners being disposed in essentially identical predetermined patterns symmetrical about the midlength of each end surface and extending substantially between the mattress major surfaces, whereby the patterns on the end surfaces are essentially the same relative to an actual mattress top surface and a mattress foot end surface regardless of which major surface is the top surface and which end surface is the foot end surface;

the bottom sheet is a simple rectangular piece of fabric having obverse and reverse surfaces and opposite side edges and head and foot end edges, the distance between the side edges being a selected amount greater than the distance across the mattress major surface between its side surfaces, the distance between the end edges being the distance across the mattress major surface between its end surfaces plus one and one half times the distance between the mattress major surfaces and having the same number of loop fasteners on the head end as the mattress has hook fasteners on the head end and the same number of loop fasteners on the foot end as the mattress has hook fasteners on the foot end, which loop are fasteners are secured to each end of the bottom sheet on the reverse surface proximate the end edges and disposed in a predetermined pattern related to the predetermined pattern of hook fasteners on the mattress end surfaces so that the loop fasteners can overlap at least a portion of the hook fasteners on the mattress end surface.

3. The bedding system of claim 2, wherein the mattress has at least two rectangular hook fasteners on each end surface, with the longer sides of each rectangular hook fastener extending vertically substantially between the mattress major surfaces.

4. The bedding system of claim 2, wherein the mattress has at least three rectangular hook fasteners on each end surface, with the longer sides of each rectangular hook fastener extending vertically substantially between the mattress major surfaces.

5. The bedding system of claim 3, wherein the sheet has the same number of rectangular loop fasteners as the mattress has hook fasteners and a longer side of each rectangular loop fastener is secured horizontally proximate the sheet end edges.

6. The bedding system of claim 4, wherein the sheet has the same number of rectangular loop fasteners as the mattress has rectangular hook fasteners and a long side of each rectangular loop fastener is secured horizontally proximate the sheet end edges.

7. The bedding system of claim 6, wherein the hook fasteners on the mattress ends are each about one and one half to two inches wide and three to four inches long and wherein the loop fasteners on the bottom sheet are each about one and one half inches wide and three inches long.

8. A bedding system comprising (a) a mattress, (b) a bottom sheet releasibly connectable to the mattress via the agency of cooperating hook fasteners on the mattress and loop fasteners on the bottom sheet; and (c) a top sheet releasibly connectable to the mattress via the agency of the cooperating hook fasteners on the mattress and loop fasteners on the top sheet:

the mattress having opposite top and bottom major surfaces with opposite side edges and end edges and being bounded by head and foot end mattress surfaces and side mattress surfaces normal to the major surfaces, the mattress having a plurality of hook fasteners secured to the mattress head and foot end surfaces for connecting the bottom sheet, the fasteners being disposed in essentially identical predetermined patterns symmetrical about the midlength of each end surface and extending substantially between the mattress major surfaces, whereby the patterns on the end surfaces are essentially the same relative to an actual mattress top surface and a mattress foot end surface regardless of which major surface is the top surface and which end surface is the foot end surface;

the bottom sheet is a simple rectangular piece of fabric having obverse and reverse surfaces and opposite side edges and head and foot end edges, the distance between the side edges being a selected amount greater than the distance across the mattress major surface between its side surfaces, the distance between the end edges the distance across the mattress major surface between its end surfaces plus one and one half times the distance between the mattress major surfaces and having the same number of loop fasteners on the head end as the mattress has hook fasteners on the head end and the same number of loop fasteners on the foot end as the mattress has hook fasteners on the foot end, which loop fasteners are secured to each end of the bottom sheet on the reverse surface proximate the end edges and disposed in a predetermined pattern related to the predetermined pattern of hook fasteners on the mattress end surfaces so that the loop fasteners can overlap at least a portion of the hook fasteners on the mattress end surfaces;

the top sheet having obverse and reverse surfaces and opposite side edges and head and foot end edges, the distance between the side edges being a selected amount greater than the distance across the width of the major surface of the mattress between its side surfaces, the distance between the end edges being the distance across the length of the major surface of the mattress between its end surface plus at least the distance between the major surfaces of the mattress, the top sheet having loop fasteners secured to the foot end of the top sheet on the reverse surface proximate the foot end edge and disposed in a predetermined pattern which is related to the predetermined pattern of the hook fasteners on the mattress end surfaces so that the loop fasteners can overlap the lower portion of the hook fasteners on the mattress foot end surface, with the number of loop fasteners on the foot end of the top sheet being the same as the number of hook fasteners on the mattress foot end surface.

9. The bedding system of claim 8, wherein the mattress has at least two rectangular hook fasteners on the mattress end surfaces extending vertically substantially between the mattress major surfaces; wherein the bottom sheet is a simple rectangular piece of fabric having the same number of loop fasteners on the head end as the mattress has hook fasteners on the head end and the same number of loop fasteners on the foot end as the mattress has hook fasteners on the foot end; and wherein the top sheet is a simple rectangular piece of fabric having the same number of loop fasteners on the foot end as the mattress has hook fasteners on the foot end.

10. A bedding system comprising (a) a mattress, (b) a bottom sheet, and (c) a draw sheet, the bottom sheet and the draw sheet being releasibly connectable to the mattress via the agency of cooperating hook fasteners on the mattress and loop fasteners on the bottom sheet and the draw sheet;

the mattress having opposite top and bottom major surfaces and opposite side edges and end edges and being bounded by head and foot end mattress surfaces and side mattress surfaces normal to the major surfaces, the mattress having a plurality of hook fasteners secured to the mattress head and foot end surfaces for connecting the bottom sheet, with the fasteners being disposed in essentially identical predetermined patterns symmetrical about the midlength of each end surface and extending substantially between the mattress major surfaces, the mattress having a plurality of hook fasteners secured to the mattress major surfaces proximate the side edges for connecting the draw sheet and disposed in essentially identical predetermined patterns symmetrical about the midlength of each major surface, whereby the patterns on the end surfaces and major surfaces are essentially the same relative to an actual mattress major top surface and a mattress foot end surface regardless of which major surface is the top surface and which end surface is the foot end surface;

the bottom sheet having obverse and reverse surfaces and opposite side edges and head and foot end edges, the distance between the side edges being a selected amount greater than the distance across the mattress major surface between its side surfaces, the distance between the end edges being the distance across the mattress major surface between its end surfaces plus one and one half times the distance between the mattress major surfaces, the bottom sheet having a plurality of loop fasteners secured to each end of the bottom sheet on the reverse surface proximate the end edges and disposed in a predetermined pattern related to the predetermined pattern of hook fasteners on the mattress end surfaces, so that the loop fasteners overlap at least a portion of the hook fasteners on the mattress end surfaces;

the draw sheet having obverse and reverse surfaces and opposite side edges and end edges, the distance between the side edges being a selected amount less than the distance across one of the mattress major surfaces between the mattress end surfaces, the distance between the end edges being a selected amount greater than the distance across one of the mattress major surfaces between the side surfaces plus a selected amount greater than twice the distance between the mattress major surfaces, with the amount selected being sufficient for releasibly connecting the draw sheet to the hook fasteners on the bottom major surface of the mattress, and a plurality of loop fasteners secured to each end of the draw sheet on the reverse surface and disposed proximate the end edges in a predetermined pattern related to the predetermined pattern of hook fasteners on the mattress major surfaces so that the loop fasteners on the draw sheet ends overlap at least a portion of the hook fasteners on the bottom major surface of the mattress.

11. The bedding system of claim 10, wherein the bottom sheet is a simple rectangular piece of fabric having the same number of loop fasteners on the head end as the mattress has hook fasteners on the head end and the same number of loop fasteners on the foot end as the mattress has hook fasteners on the foot end and wherein the draw sheet is a simple rectangular piece of fabric having the same number of loop fasteners on each end as the mattress has hook fasteners on the major surfaces.

12. The bedding system of claim 11, wherein the mattress has at least two rectangular hook fasteners on each end surface and on each major surface, with the longer sides of each rectangular hook fastener on the end surfaces extending vertically substantially between the mattress major surfaces and with a longer side of each rectangular hook fastener on the major surfaces extending horizontally proximate the side edges of the mattress major surfaces.

13. The bedding system of claim 11, further comprising (d) a releasibly connectable top sheet having loop fasteners for use with the mattress via the agency of the cooperating hook fasteners on the mattress ends the top sheet having obverse and reverse surfaces, opposite side edges, and opposite foot and head end edges, the distance between the side edges being a selected amount greater than the distance across the major surface of the mattress between its side surfaces, the distance between the end edges being the distance across the major surface of the mattress between its end surface plus at least the distance between the major surfaces of the mattress, and having the loop fasteners secured only to the foot end of the top sheet on the reverse surface proximate the edge and disposed horizontally proximate the foot end edge in a predetermined pattern which is related to the predetermined pattern of the hook fasteners on the mattress end surfaces so that the loop fasteners can overlap at least a portion of the hook fasteners on the mattress foot end surface, with the number of loop fasteners being the same as the nun%her of hook fasteners on the mattress foot end surface.

14. The bedding system of claim 13, wherein the mattress has at least two rectangular hook fasteners on each end surface and each major surface, with the longer sides of each rectangular hook fastener on the end surfaces extending vertically substantially between the mattress major surfaces and with a longer side of each rectangular hook fastener on the major surfaces disposed horizontally proximate the mattress side edges; wherein the bottom sheet and the top sheet are simple rectangular pieces of fabric, with the bottom sheet having the same number of rectangular loop fasteners on the head and foot ends as the mattress has hook fasteners on the head and food ends and with the top sheet having the same number of rectangular loop fasteners on the foot end as the mattress has hook fasteners on the foot end, and with a longer side of each rectangular loop fastener on the bottom sheet being secured proximate the bottom sheet head and foot end edges and with a longer side of each rectangular fastener on the top sheet being secured horizontally only proximate the top sheet foot end edges; wherein the draw sheet is a simple rectangular piece of fabric having the same number of rectangular loop fasteners on each end as the mattress has hook fasteners on the major surfaces.

15. The blending system of claim 14, wherein at least a portion of the observe surface of the draw sheet is quilted, with the quilted portion covering the top major surface of the mattress and wherein the draw sheet optionally has a pocket on the obverse side.

16. The bedding system of claim 12, wherein the hook fasteners on the mattress ends are each about two inches by four inches; wherein the hook fasteners on the mattress major surfaces are about two inches by three inches long; wherein the loop fasteners on the bottom sheet are each about one and one half inches by three inches; and wherein the loop fasteners on the draw sheet are about one and one half inches by three inches.

17. The bedding system of claim 14, wherein the hook fasteners on the mattress ends are each about two inches by four inches; wherein the hook fasteners on the mattress major surfaces are about two inches by three inches; wherein the loop fasteners on the bottom sheet and top sheet are each about one and one half inches by three inches; and wherein the hook fasteners on the draw sheet are about one and one half inches by three inches.

18. A method of making a bed using the bedding system of claim 8, which comprises the steps of:

a. placing the reverse surface of the bottom sheet on the top mattress surface so that the entire head end surface and only the upper half of the foot end surface of the mattress is covered, with the lower half of the foot end surface being uncovered;

b. aligning the loop fasteners on the sheet ends with the hook fasteners on the mattress end surfaces and connecting the fasteners;

c. placing the reverse surface of the top sheet over the bottom sheet so that the foot end surface of the top sheet completely covers the foot end surface of the mattress; and d. aligning the loop fasteners on the top sheet end with the uncovered bottom portion of the hook fasteners on the mattress foot end and connecting the fasteners.

19. A method of making a bed using the bedding system of claim 10, which comprises the steps of:

a. placing the reverse surface of the bottom sheet on the top mattress surface so that the head end surface is covered and only the upper half of the foot end surface of the mattress is covered, with the lower half of the foot end surface being uncovered;

b. aligning the loop fasteners on the sheet ends with the hook fasteners on the mattress end surfaces and connecting the fasteners;

c. placing the reverse surface draw sheet over the bottom sheet so that it covers the central portion of the bottom sheet and extends down the mattress side edges; and d. aligning the loop fasteners on the ends of the draw sheet with the hook fasteners located proximate the edge of the mattress bottom major surface, and connecting the loop fasteners on the draw sheet to the hook fasteners on the edge of the mattress bottom major surface.

20. A method of making a bed using the bedding system of claim 14, which comprises the steps of:

a. placing the reverse surface of the bottom sheet on the top mattress surface so that the entire head end surface of the mattress is covered and only the upper half of the foot end surface of the mattress is covered, with the lower half of the foot end surface being uncovered;

b. aligning the loop fasteners on the bottom sheet ends with the hook fasteners on the mattress end surfaces and connecting the fasteners;

c. placing the reverse surface of the draw sheet over the bottom sheet so that it covers the central portion of the bottom sheet and extends down the mattress side edges;

d. aligning the loop fasteners on the ends of the draw sheet with the hook fasteners located proximate the edge of the mattress bottom major surface, and connecting the loop fasteners of the draw sheet with the hook fasteners proximate the mattress bottom major surface;

e. placing the reverse surface of the top sheet over the bottom sheet so that the foot end surface of the top sheet completely covers the foot end surface of the mattress; and f. aligning the loop fasteners on the top sheet end with the uncovered bottom portion of the hook fasteners on the mattress foot end and connecting the fasteners.

* * * * *